United States Patent [19]

Dion-Biro

[11] 4,195,692

[45] Apr. 1, 1980

[54] FIRE-FIGHTING NOZZLE ASSEMBLY

[76] Inventor: Guy Dion-Biro, 46 Av du Chateau, 94.300 Vincennes, France

[21] Appl. No.: 873,491

[22] Filed: Jan. 30, 1978

[30] Foreign Application Priority Data

Jan. 28, 1977 [FR] France ..... 77 02373

[51] Int. Cl.[2] ..... A62C 31/02

[52] U.S. Cl. ..... 169/25; 239/587

[58] Field of Search ..... 239/587, 588; 169/25; 285/134, 135, 136, 132

[56] References Cited

U.S. PATENT DOCUMENTS

| | | | |
|---|---|---|---|
| 1,880,826 | 10/1932 | Corley | 239/587 X |
| 3,410,493 | 11/1968 | Dion-Biro | 239/587 |
| 3,567,136 | 3/1971 | Garrett | 285/134 |
| 3,840,070 | 10/1974 | Clark | 239/587 X |

*Primary Examiner*—Robert W. Saifer

*Attorney, Agent, or Firm*—Haseltine, Lake & Waters

[57] ABSTRACT

A fire-fighting cannon nozzle assembly comprisees first and second feed conduits which become coaxial in a rotary sleeve assembly and extend through a body assembly and also through a swivel joint assembly for simultaneous projection of two fire-fighting agents. The rotary sleeve assembly provides for rotary movement of the body assembly about a vertical axis and the swivel joint assembly provides for rotary movement of the discharge nozzles about a horizontal axis.

8 Claims, 2 Drawing Figures

FIRE-FIGHTING NOZZLE ASSEMBLY

BACKGROUND OF THE INVENTION

Cannon nozzles are known for projecting liquid, gaseous fluid or solid fire extinguishing agents, which are mounted on a pivot for permitting the jets of fire extinguishing substance to be projected in all directions to fight fire in which liquefied products are burning. Unfortunately such known apparatus permit only a single agent to be projected onto a fire. If two agents are to be projected, it is necessary to use two nozzles and therefore two pivots, and in this case two people are required to operate the nozzles. If the two nozzles are coupled together in pairs, their range of operating movement is limited and it is impossible to project over a full range of 360°.

Attempts have been made hitherto to provide nozzle construction which permit independent movement of the nozzle, for example by mounting the two nozzles on coaxially and totally independent sleeves. However, taking into account mechanical tolerances, with this construction it was impossible to bring then all the nozzles into the proper state of coincidence, to project onto a fire to be extinguished. In addition, the sleeve arrangement often resulted in the components becoming hard to move and even becoming locked, which makes it impossible to use the apparatus.

SUMMARY OF THE INVENTION

An object of the present invention is to remedy the above disadvantages and to provide a nozzle assembly for the simultaneous projection of two fire extinguishing agent jets, such as two fluids, a solid and a liquid, a solid and a gas, or a liquid and a gas or the like, while also permitting a horizontal rotary movement and a vertical movement of said nozzle assembly.

The nozzle assembly according to the invention comprises two coaxial conduits, each provided with a rotary sleeve assembly for permitting horizontal rotary movement of the nozzle assembly, and each also passing through a swivel joint for permitting vertical rotary movement of the nozzles. Of the two coaxial conduits, which at the discharge end of the nozzle body are each provided with a device for projecting the respective agent therefrom, the outer annular conduit is formed by the body of the nozzle assembly, and the inner or central conduit is formed by a flexible tube which is held in place in the body by a spacer or bracer members and which is capable of following the rotary movements of the swivel joint. The fire-fighting agents are introduced into the nozzle assembly by two independent conduits which become coaxial in the base of the nozzle assembly.

Other objects and advantages of the present invention will be better understood with reference to the accompanying drawings.

DESCRIPTION OF THE PREFERRED EMBODIMENT

Figure 1:
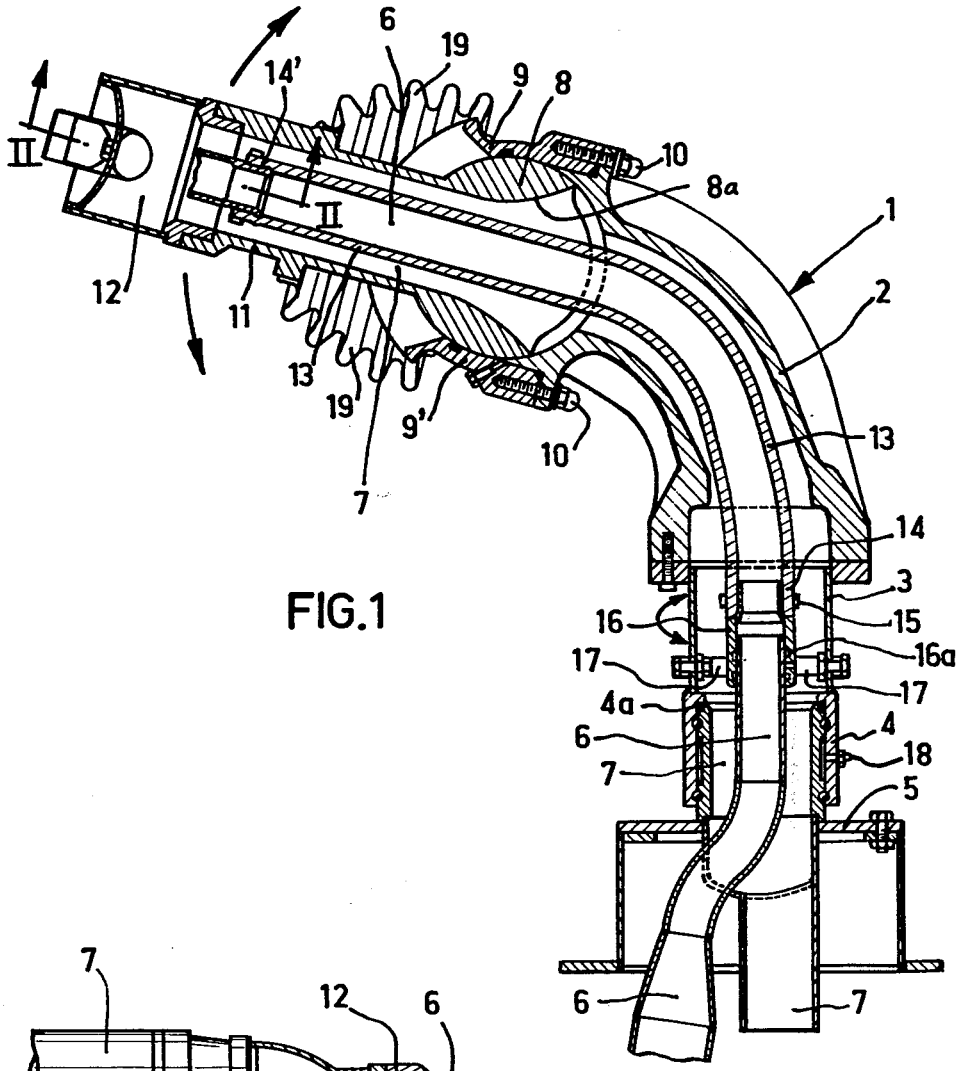
FIG. 1 is a view in cross-section of a cannon nozzle assembly.

Reference is made to FIG. 1 which shows a cannon nozzle assembly 1 comprising a curved body 2 mounted by means of a collar 3 on a rotary ball sleeve assembly 4 of known type. The sleeve assembly 4 provides for pivotal movement of the body 2 about a vertical axis, and is itself mounted on a support 5 of the nozzle assembly.

Two feed conduits 6 and 7 extend into the support 5, for supplying the two agents to be projected simutlaneously. The conduits 6 and 7 become coaxial within the support 5, although the agents flowing in the conduits 6 and 7 are of course still separated at this position.

A swivel joint 8 is mounted at the end of the body 2 remote from the assembly 4 by means of two casing or shell members 9 and 9' which are held in place by fixing screws 10 on the body 2. The swivel joint 8 is provided with a cylindrical body 11, and a discharge breech pipe 12 is mounted at the end of the body 11. The swivel joint 8 is pivotal about a horizontal axis.

A flexible tube 13 is disposed coaxially within the body 2 of the nozzle assembly. One end 14 of the flexible tube 13 is fixed to the end of the central one of the conduits 6 and 7, in the embodiment illustrated, this being the conduit 6. The end 14 is fixed by means of a collar 15 which thus fixes the end 14 sealingly on a smooth bearing and connection sleeve 16 which is held in position on the axis of the nozzle body 2 by means of bracer members 17. The sleeve 16 surrounds the upper end of the feed conduit 6. The other end 14' of the flexible tube 13 is fixed to one of the outlets of the outlet pipe 12 (see FIG. 2).

The sleeve assembly 4 comprises a lubricating means 18, for lubricating the bearing surfaces and members of the assembly 4. The collar 3 which is fixed to the assembly 4 carries the members 17 holding the flexible tube 13 as indicated above. The members 17 may also be formed by tubes also serving for lubrication of the sleeve 16. The sleeve assembly 4 and sleeve 16 comprise sealing gaskets 4*a* and 16*a* respectively. It will be seen that the body 2 and the tube 13 can be rotated about the vertical axis provided by the assembly 4 and 16, while agent supplied through conduit 6 flows through tube 13 and agent from conduit 7 flows through body 2.

The swivel joint 8 comprises a recess 8*a* which permits the internal flexible tube 13 to pass into and through the swivel joint 8, irrespective of its angle of inclination, and a protective bellows member 19 is disposed on the outside of the swivel joint 8 to prevent e.g. dust from entering the joint. The rotary movement of the swivel joint 8 about its horizontal axis can be facilitated or restrained by adjustment of the fixing screws 10 which fix the members 9 and 9' to the body.

Figure 2:
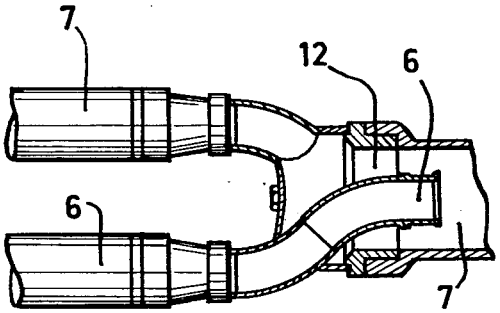
FIG. 2 is a view in section taken along line II—II in FIG. 1.

Reference is now made to FIG. 2 which shows a view in section taken along line II—II in FIG. 1, of the outlet pipe 12 which is e.g. screwed onto the free end of the body 11 of the nozzle 1. References 6 and 7 in FIG. 2 denote the discharge flow conduits which are respectively connected to tube 13 and body 2 and which separate from each other in the outlet pipe 12 and become independent therein. It will be appreciated that the flow conduits are coaxial only where they pass through the pivotal joints 4 and 8, and in the body 2 between the joints.

It will be seen that movements of the above-described nozzle assembly may be achieved with a minimum of effort, the pivotal forces and movements being controlled only by the external parts and the internal parts only being provided to ensure sealing of the agents flowing through the nozzle assembly. It is therefore possible to project two different agents simultaneously or alternatively, in any direction.

Various modifications may be made without thereby departing from the scope of the present invention as defined by the appended claims.

What is claimed is:

1. A fire-fighting cannon nozzle assembly for simultaneous discharge of two fire-fighting agents, comprising: a body assembly; a pair of substantially coaxial nozzle conduits for said agents in the body assembly; feed conduits for said agents; nozzle discharge means adapted to allow outlet of said agents; and means for rotary movement of said body assembly in a horizontal plane, said body assembly being further provided with a swivel joint means; said swivel joint means accomodating of said pair of nozzle conduits and allowing for rotary movement of part of said nozzle assembly in a vertical plane about a horizontal axis, each nozzle conduit being provided with a rotary and sealing sleeve for the simultaneous rotary movement of said body assembly about a vertical axis.

2. A fire-fighting cannon nozzle assembly according to claim 1, wherein: said body assembly is provided with a first end connected to an assembly of said rotary and sealing sleeves; said rotary and sealing sleeve assembly housing the two feeding conduits; said conduits being separate from each other for receiving the separate agent flows free from mixture within said body assembly and being rotatable during use of the nozzle assembly about the vertical axis of said sleeve assembly; a second end of said body assembly being provided with said swivel joint assembly, and said nozzle conduits being in coaxial relationship within said swivel joint assembly; and said nozzle discharge means being in fluid communication with said swivel joint assembly and being rotatable about the horizontal axis thereof.

3. An assembly according to claim 2 wherein said discharge conduit means are substantially coaxial with each other and are each connected to a respective non-coaxial discharge conduit member for discharge and projection of the respective said agent.

4. A fire-fighting cannon nozzle assembly according to claim 1, wherein: said pair of substantially coaxial conduits comprises an outer annular conduit and an inner conduit, each respective conduits being connected to a respective feed conduit.

5. An assembly according to claim 4 wherein the outer annular conduit means is formed by a body portion of the body assembly.

6. An assembly according to claim 5 wherein the inner conduit means is formed by a flexible tube within the body portion.

7. An assembly according to claim 6 wherein said inner conduit flexible tube is fixed to a smooth bearing and connection sleeve held substantially coaxially within the outer annular conduit by holding members.

8. An assembly according to claim 4 wherein the outer annular conduit is fixed on an outer part of said rotary sleeve assembly, which is provided with sealing means.

* * * * *